US009595777B2

(12) United States Patent
Byrne et al.

(10) Patent No.: US 9,595,777 B2
(45) Date of Patent: Mar. 14, 2017

(54) LOW PROFILE ELECTRICAL TERMINAL ASSEMBLY

(71) Applicants: Norman R. Byrne, Ada, MI (US); Robert L. Knapp, Rockford, MI (US); Steven K. Meek, Grand Rapids, MI (US); Matthew R. Andree, Rockford, MI (US)

(72) Inventors: Norman R. Byrne, Ada, MI (US); Robert L. Knapp, Rockford, MI (US); Steven K. Meek, Grand Rapids, MI (US); Matthew R. Andree, Rockford, MI (US)

( * ) Notice: Subject to any disclaimer, the term of this patent is extended or adjusted under 35 U.S.C. 154(b) by 0 days.

(21) Appl. No.: 15/091,688

(22) Filed: Apr. 6, 2016

(65) Prior Publication Data

US 2016/0301169 A1 Oct. 13, 2016

Related U.S. Application Data

(60) Provisional application No. 62/143,930, filed on Apr. 7, 2015.

(51) Int. Cl.

| | |
|---|---|
| ***H01R 25/16*** | (2006.01) |
| ***H01R 25/00*** | (2006.01) |
| ***H01R 9/22*** | (2006.01) |
| *H01R 4/18* | (2006.01) |
| *H01R 11/05* | (2006.01) |
| *H01R 13/11* | (2006.01) |
| *H01R 24/28* | (2011.01) |

(52) U.S. Cl.
CPC ..... *H01R 9/226* (2013.01); *H01R 4/184* (2013.01); *H01R 11/05* (2013.01); *H01R 13/111* (2013.01); *H01R 24/28* (2013.01)

(58) Field of Classification Search
CPC ..... H02G 3/288; H01R 25/162; H01R 25/003
See application file for complete search history.

(56) References Cited

U.S. PATENT DOCUMENTS 2,707,203 A * 4/1955 Peters ..... H02G 3/16 174/59
2,917,724 A * 12/1959 Jackson ..... H01R 9/00 174/59

(Continued)

*Primary Examiner* — Briggitte R Hammond
(74) *Attorney, Agent, or Firm* — Gardner, Linn, Burkhart & Flory, LLP

(57) ABSTRACT

An electrical terminal assembly is provided for use in a low-profile electrical raceway or the like. The terminal assembly includes first and second conductive bodies and an insulator disposed between them. The first body has at least two branches including respective electrical terminals extending outwardly from a main or central portion, with the terminals positioned in a terminal plane. The second body also has at least two branches including respective electrical terminals extending outwardly from a main or central portion, with the terminals positioned in the same terminal plane as the terminals of the first body. The terminals of the second body are positioned next to respective terminals of the first body. The central portions of the first and second bodies are stacked atop one another and therefore lie in different planes, at least one of which is different from the terminal plane.

19 Claims, 4 Drawing Sheets

(56) References Cited

U.S. PATENT DOCUMENTS

| | | | | | |
|---|---|---|---|---|---|
| 3,848,224 | A * | 11/1974 | Olivero | H02G 3/16 | 428/366 |
| 4,313,646 | A * | 2/1982 | Millhimes | H01R 31/02 | 439/215 |
| RE31,033 | E * | 9/1982 | Wilson, Jr. | H02G 3/16 | 439/654 |
| 4,357,070 | A * | 11/1982 | Fukushima | H01R 13/213 | 439/287 |
| 4,875,871 | A * | 10/1989 | Booty, Sr. | H02G 3/00 | 439/210 |
| 5,203,713 | A * | 4/1993 | French | H02G 3/288 | 439/211 |
| 5,529,509 | A * | 6/1996 | Hayes | H01R 11/12 | 439/288 |
| 6,929,514 | B1 * | 8/2005 | Chuang | H01R 31/02 | 439/108 |
| 7,867,044 | B2 * | 1/2011 | Lee | H01R 4/305 | 439/108 |
| 8,105,121 | B2 * | 1/2012 | Miyamoto | H01R 4/646 | 439/883 |
| 8,262,401 | B1 * | 9/2012 | Byrne | H01R 25/162 | 439/215 |
| 2008/0188106 | A1 * | 8/2008 | Byrne | H02G 3/288 | 439/215 |
| 2009/0130879 | A1 * | 5/2009 | Johnson | H01R 25/16 | 439/215 |

* cited by examiner

LOW PROFILE ELECTRICAL TERMINAL ASSEMBLY

CROSS REFERENCE TO RELATED APPLICATION

The present application claims the benefit of U.S. provisional application Ser. No. 62/143,930, filed Apr. 7, 2015, which is hereby incorporated herein by reference in its entirety.

FIELD OF THE INVENTION

The present invention relates to electrical power systems for use in work areas and, more particularly, to electrical terminals for use in modular electrical systems.

BACKGROUND OF THE INVENTION

Modular electrical power systems are typically used in office areas and other work areas or places where access to electrical power is desirable, and particularly in flexible areas that are designed to be reconfigurable to suit changing needs, such as with movable partition walls and other furnishings. In some cases, it is desirable to set up electrical power systems in exposed locations, such as along floors or walls, in which case it may be particularly desirable to use electrical conduits and connectors that have very low overall thickness, especially when used in walking areas.

SUMMARY OF THE INVENTION

The present invention provides a low profile electrical terminal assembly, such as for use in a junction of a modular electrical system, in which a plurality of electrical terminals are arranged in generally the same plane (i.e., arranged between two substantially parallel planes that are in close proximity), and that permit the establishment of electrical connections. The low profile electrical terminal assembly is particularly well adapted for routing power in different directions from a junction point in a modular electrical system, and has a very thin or minimally intrusive thickness. The assembly includes at least two conductive main bodies that are stacked one on top of the other at close spacing, optionally with an insulating body disposed in between. Each conductive body has respective conductor arms or branches that radiate or extend outwardly from a central main body region, and the arms or branches terminate with respective electrical terminals located outboard of the main body. The branches or arms of at least one conductive body are bent or otherwise formed to position the electrical terminals along a different plane than that of the associated main body. This permits the electrical terminals of each main body to lie in a common plane, while the corresponding main bodies are stacked in different (typically parallel) planes. To avoid inadvertent contact between the arms or branches of one main body, and the arms or branches of another main body, the branches of one body are laterally offset from the branches of the other body or bodies so that, when viewed from above or in plan view, the conductor arms or branches do not overly one another. This arrangement allows for the close-proximity stacking of two or more conductive main bodies, but with the respective electrical terminals all located substantially within the same plane as one another so that the overall thickness of the assembly is minimized.

According to one form of the present invention, an electrical terminal assembly is provided for use in a low profile electrical raceway or the like. The assembly includes first and second conductive bodies, each having at least two electrical terminals extending outwardly therefrom, at the ends of respective conductor arms or branches. The first conductive main body is located in a first plane, with the conductor branches or arms radiating outwardly, and with the respective electrical terminals at the ends of the branches or arms positioned in a terminal plane. The second conductive main body is located in a second plane, spaced below the first plane, and its conductor arms or branches extend substantially radially outwardly so that the respective electrical terminals associated with the second main body are positioned in the same terminal plane as the terminals of the first main body. One of the electrical terminals of the first main body is positioned adjacent a first of the electrical terminals of the second main body, while a second of the electrical terminals of the first main body is positioned adjacent a second of the electrical terminals of the second main body. Optionally, an electrically insulative body is disposed between the first and second main bodies.

In one aspect, the terminal plane is non-coplanar with at least one of the first and second planes of the first and second conductive main bodies.

In another aspect, the electrical terminals at the ends of the conductor arms are female terminals. Optionally, the female terminals are configured to receive male blade terminals or bus bars.

In still another aspect, a third conductive main body is located in a third plane, which is spaced below the second plane of the second conductive main body. The third conductive main body has at least two conductor arms or branches extending radially outwardly therefrom, with respective electrical terminals at the ends of the arms, and the terminals located in the same terminal plane as the electrical terminals of the first and second main bodies. Optionally, an insulative body is positioned between the second and third main bodies.

Thus, the low profile electrical terminal assembly of the present invention allows for close stacking of electrical conductors having different polarities, with conductor arms or branches extending radially outwardly and having respective electrical terminals that are located in a common terminal plane, such as for engaging respective conductors of a corresponding electrical connector. This permits the construction and assembly of low profile electrical raceways and junctions for routing power in different directions throughout a work area or the like, and may even permit the installation of low profile electrical raceways along a floor surface that includes walking areas.

These and other objects, advantages, purposes and features of the present invention will become apparent upon review of the following specification in conjunction with the drawings.

DESCRIPTION OF THE PREFERRED EMBODIMENTS

Figure 1:
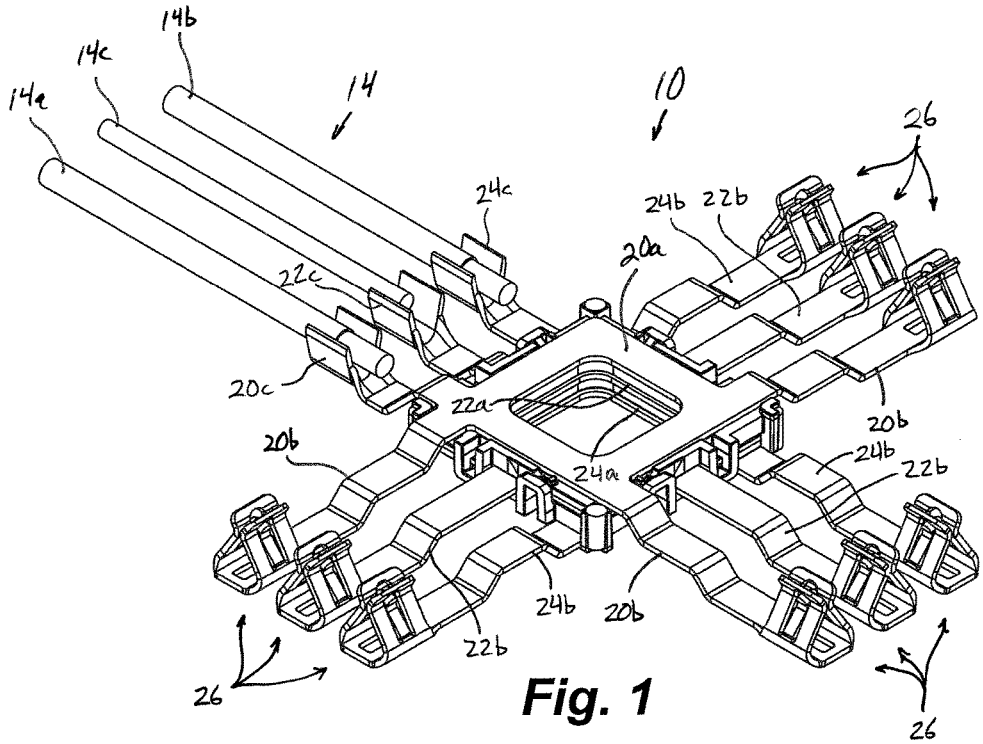
FIG. 1 is a top perspective view of a low profile electrical terminal assembly in accordance with the present invention.

Referring now to the drawings and the illustrative embodiments depicted therein, a low profile electrical terminal assembly 10 is configured for mounting in a raceway junction 12, such as shown in FIGS. 1, 2 and 7-8B. Raceway junction 12 receives or conveys electrical power from electrical conductors 14 that are routed through a raceway 16, which is coupled to raceway junction 12. In the illustrative embodiment of FIGS. 2 and 7, raceway junction 12 includes three electrical receptacles 18 corresponding to three sets of electrical terminals of electrical terminal assembly 10, as will be described below. The configuration of low profile electrical terminal assembly 10 permits two or more conductive bodies to be positioned in a thinly stacked arrangement, which facilitates a thin or low profile construction for raceway junction 12, which may be used to route electrical power in different directions and to different locations within a region such as work area.

Figure 3:
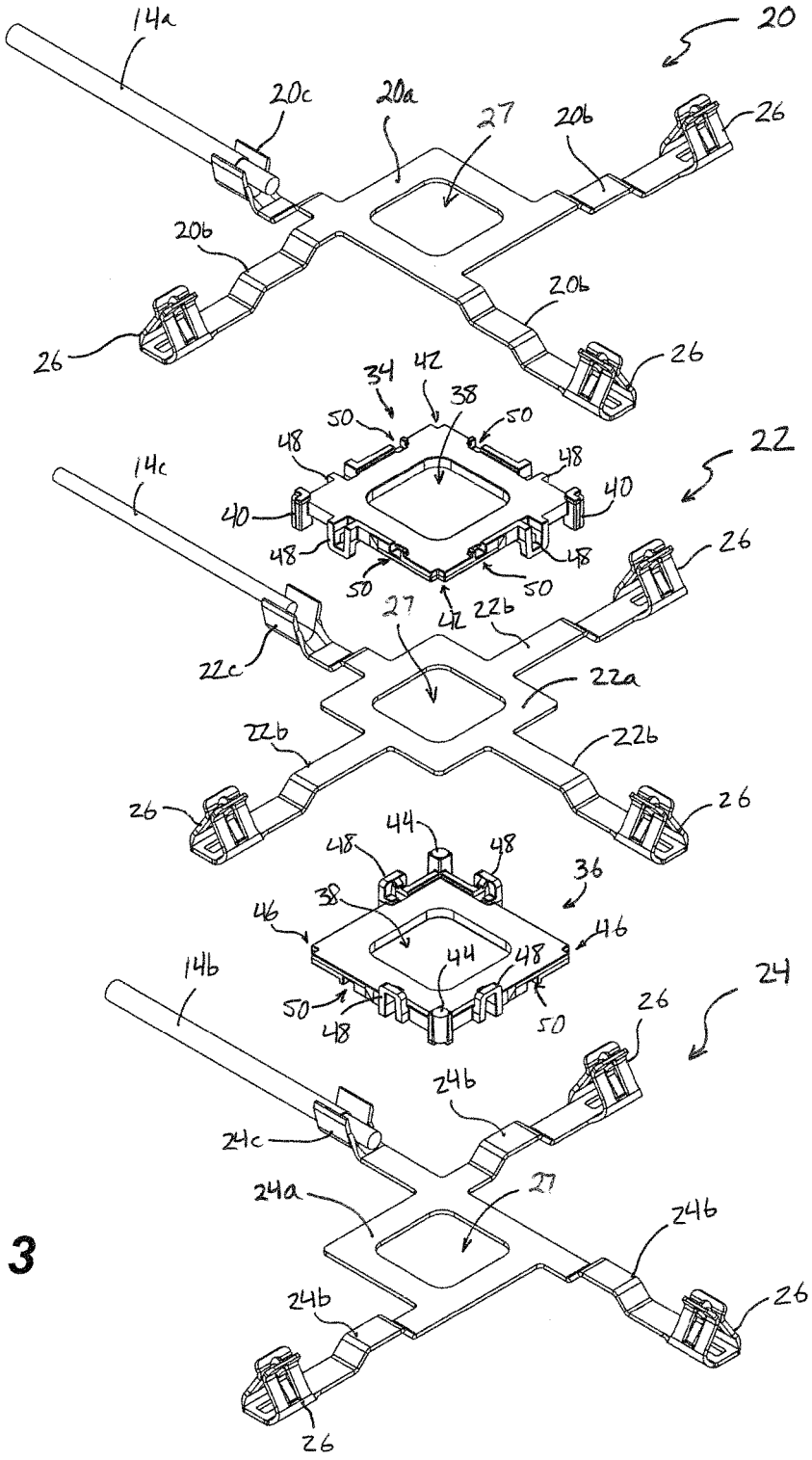
FIG. 3 is an exploded perspective view of the electrical terminal assembly of FIG. 1.
Figure 4:
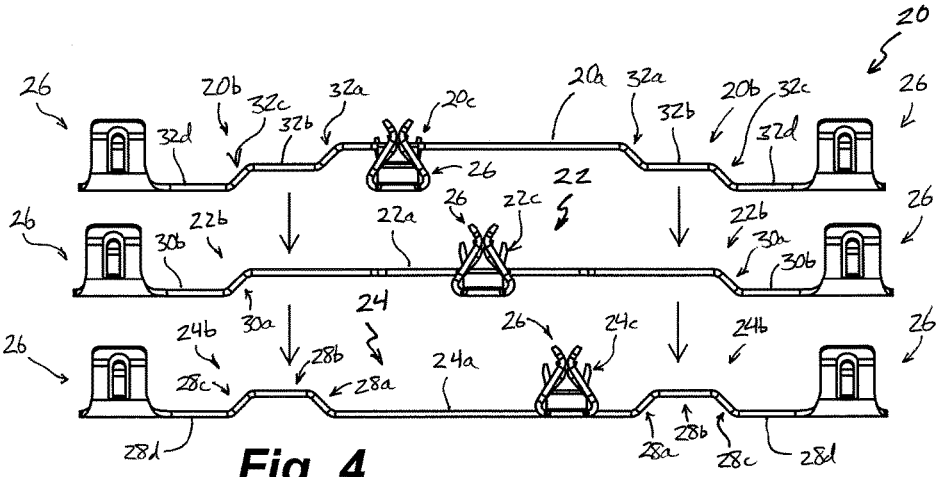
FIG. 4 is a side elevation of the three conductive bodies of the electrical terminal assembly of FIG. 1, shown in a vertically spaced arrangement.

In the illustrated embodiment, low profile electrical terminal assembly 10 includes three electrically conductive bodies or elements including a "hot" or line body 20, a ground body 22, and a neutral body 24, such as shown in FIGS. 3 and 4. Each electrically conductive body 20, 22, 24 has a respective main or central body portion 20*a*, 22*a*, 24*a* and also three conductor arms or branches 20*b*, 22*b*, 24*b*, that radiate or extend outwardly from the respective central body portions 20*a*, 22*a*, 24*a*. In addition, each of the conductor bodies includes a respective crimp terminal 20*c*, 22*c*, 24*c* for engaging a respective one of the electrical conductors 14. Each arm or branch 20*b*, 22*b*, 24*b* has an electrical terminal 26 at its distal end. In the illustrated embodiment, electrical terminals 26 are each configured to establish six or more points of contact with a male blade terminal, bus bar, or the like, such as described in commonly-owned U.S. patent application Ser. No. 15/054,708, filed Feb. 26, 2016, entitled ELECTRICAL CONTACT RECEPTACLE FOR BUS BARS AND BLADE TERMINALS, which is hereby incorporated herein by reference in its entirety. It will be appreciated that the precise style or configuration of electrical terminals may be varied according to the needs of a particular application, and is not necessarily limited to the style of electrical terminals 26 disclosed herein. However, the disclosed electrical terminals 26 are capable of establishing significant contact surface area with a blade terminal or the like, and thus are suitable for low profile applications such as described herein.

In the illustrated embodiment, each main or central body portion 20*a*, 22*a*, 24*a* is generally square in shape when viewed from above, and defines a central opening 27, such as for material and weight savings. Line body 20 has its arms or branches 20*b* extending off of three sides of the generally square main body portion 20*a*, each branch being generally arranged as an extension of a respective leg forming the square main body portion 20*a*. Similarly, crimp terminal 20*c* extends radially outwardly off of a fourth side of main body portion 20*a*. The neutral body's arms or branches 22*b* extend radially outwardly from respective sides of the generally square main body portion 22*a*, but branches 22*b* extend outwardly from a middle or central region of each leg of the square main body portion 22*a*. For purposes of the present application, it will be appreciated that the term "radially" is used to refer to any outwardly-extending direction.

Similarly to branches 22*b*, crimped terminal 22*c* extends radially outwardly from the central region of the fourth side of the square main body portion 22*a*. The neutral body's arms or branches 24*b* are arranged similarly to those of line body 20, except that arms 24*b* are extensions of opposite legs of each side of the generally square main body portion 24*a*. It will be appreciated that line body 20, ground body 22, and neutral body 24 may each be unitarily formed from a single planar sheet of electrically conductive material in a stamping process such as a multi-stage stamping process in which the general plan shape is initially cut out, followed by bending or stamping operations in which the final shapes of the branches 20*b*, 22*b*, 24*b* are formed, along with the forming of crimped terminals 20*c*, 22*c*, 24*c* and electrical terminals 26.

Figure 7:
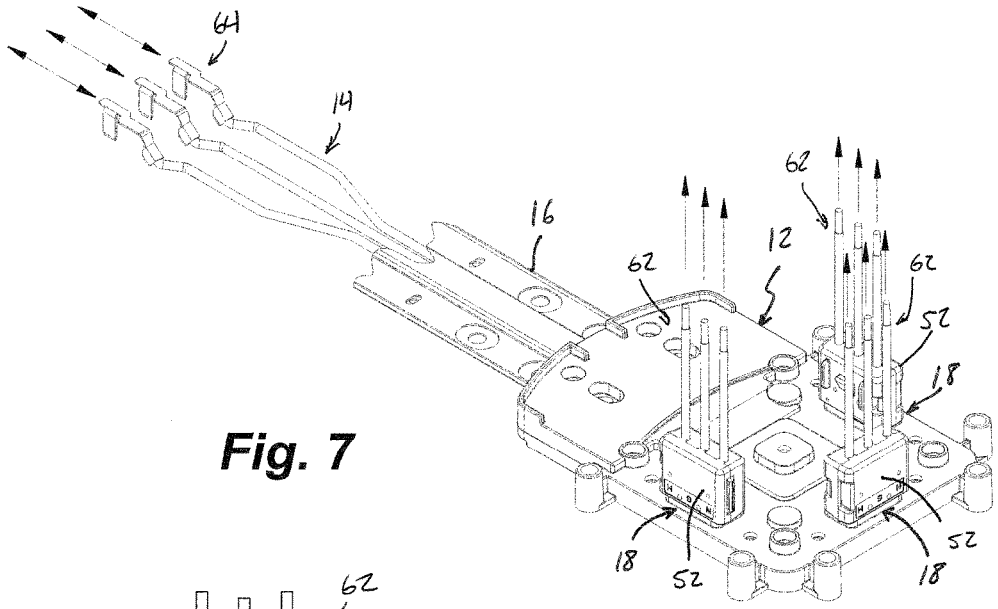
FIG. 7 is a top perspective view of the low profile raceway and raceway junction of FIG. 2.

With this arrangement of branches for each conductive body, when the bodies are stacked together such as shown in FIG. 1, the neutral body's branches 24*b* are spaced well apart from the line body's branches 20*b*, with ground body's branches 22*b* positioned between branches 20*b* and branches 24*b*. Similarly, crimped terminal 22*c* is disposed between the crimped terminals 20*c* and 24*c*. The resulting electrical terminal assembly 10 permits branching in up to three different directions while providing electrical continuity for a line conductor 14*a*, a neutral conductor 14*b*, and a ground conductor 14*c* (FIGS. 1 and 7). However, it is envisioned that more or fewer directions of branching are possible by using different shapes or arrangements of branches. For example, triangular main bodies would readily accommodate branching in two directions, and pentagonal main bodies would readily accommodate branching in four directions.

Figure 5:
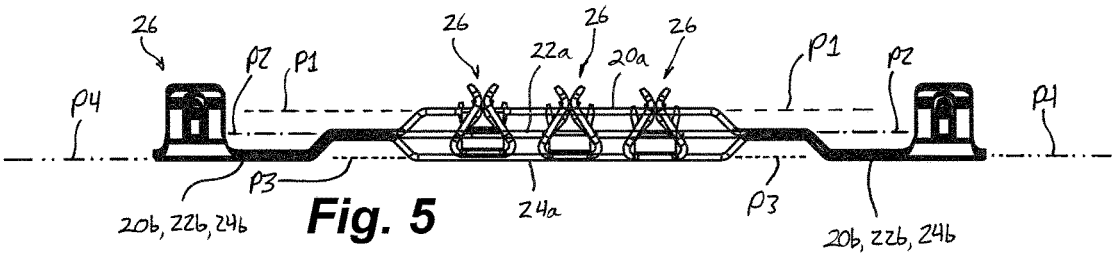
FIG. 5 is another side elevation of the conductive bodies of FIG. 4, shown in their assembled configuration.

Each main body portion 20*a*, 22*a*, 24*a* lies in a respective plane P1, P2, P3 so that main body portions 20*a*, 22*a*, 24*a* are sufficiently spaced apart in the region where the respective bodies 20, 22, 24 overlap or overlie one another, such as shown in FIG. 5. It will further be appreciated that the plane P3 in which neutral main body portion 24*a* lies is the same as a terminal plane P4 in which lower or base surfaces or portions of each terminal 26 lie. Thus, the terminal plane P4 is coplanar with the neutral main body portion 24*a*, which is spaced below the plane P2 of the ground main body portion 22*a*, which is spaced below the plane P1 of line main body portion 20*a*. In the illustrated embodiment, each terminal 26 also includes an upwardly-extending portion that extends above the base portion and, therefore, above terminal plane P4.

Each electrical terminal 26 has its base or bottom portion lying in terminal plane P4 due to the shapes of the corresponding arms or branches 20*b*, 22*b*, 24*b*, such as shown in FIG. 4. Because the neutral body's main body portion 24*a* is coplanar with terminal plane P4, neutral branches 24*b* need not change their elevation between neutral main body portion 24*a* and the corresponding electrical terminals 26. However, if clearance is needed for another component, such as in raceway junction 12, branch 24*b* may include an optional rise 28*a*, followed by an elevated region 28*b* (which may lie in the plane P2 of ground main body portion 22*a*), and a drop 28*c* back down to an end region 28*d* at the level of terminal plane P4 and the plane P3 of neutral main body portion 24*a*, such as shown in FIG. 4. Because ground main body portion 22*a* lies in plane P2 spaced above terminal plane P4, ground branches 22*b* include a drop 30*a* down to a lowered portion 30*b* that lies in terminal plane P4. Line main body portion 20*a* lies in the highest elevation plane P1 and, therefore, line branches 20*b* drop the furthest distance down to terminal plane P4. Line branches 20*b* include a first drop region 32*a*, followed by a first lowered region 32*b*, followed by a second drop region 32*c*, followed by a second lower region 32*d* that lies in terminal plane P4.

As will be apparent with reference to FIGS. 1 and 5, when electrical terminal assembly 10 is assembled, first lowered region 32*b* of line branch 20*b* lies in the same plane as ground body 22*a* and a proximal region of ground branch 22*b*, which also is the same plane in which elevated region 28*b* of neutral branch 24*b* lies, so that all of these regions generally lie in the same plane P2 as ground main body portion 22*a*. The branches associated with crimp terminals 20*c*, 22*c*, 24*c* may also be shaped in a similar manner as branches 20*b*, 22*b*, 24*b*, so that the distal ends (crimp portions) of crimp terminals 20*c*, 22*c*, 24*c* lie in the same plane as one another, such as terminal plane P4.

Figure 6:
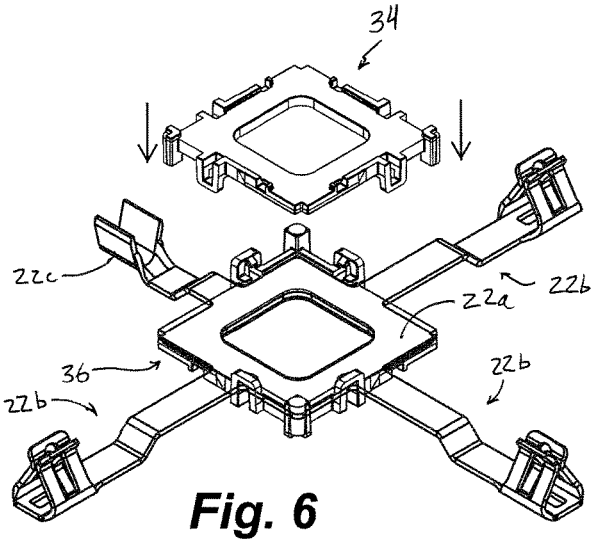
FIG. 6 is a top perspective view of the middle conductive body of FIGS. 4 and 5, shown overlying a lower insulator piece, and with an upper insulator piece spaced above and being lowered onto the middle conductive body for attachment to the lower insulator piece.

To ensure that line main body portion 20*a* does not contact or electrically arc with ground main body portion 22*a*, and to ensure that ground main body portion 22*a* does not contact or arc with neutral main body portion 24*a*, a pair of insulative bodies including a first insulator 34 and a second insulator 36 are positioned between the respective main body portions 20*a*, 22*a*, 24*a*. As best shown in FIG. 3, first insulator 34 is disposed between the line main body portion 20*a* and ground main body portion 22*a*, and second insulator 36 is disposed between ground main body portion 22*a* and neutral main body portion 24*a*. Not only do insulators 34, 36 ensure sufficient separation of the respective main body portions 20*a*, 22*a*, 24*a* during installation and operation, but they also limit or substantially prevent electrical shorts due to compressive loads atop the main body portions. This is particularly useful for applications in which the low profile electrical terminal assembly 10 is mounted along a floor surface, such as in raceway junction 12, in which case insulators 34, 36 ensure separation of the main body portions 20*a*, 22*a*, 24*a* even if significant compressive weight or force is applied above the main body portions. Such loads may be imparted, for example, by a person standing on that region, or by a piece of equipment or furniture resting along (or rolling over) the junction 12 above main body portions 20*a*, 22*a*, 24*a*. Even if the junction 12 were crushed by an overload condition, it is envisioned that electrical terminal assembly 10 would be likely to maintain sufficient separation of the various conductive surfaces to avoid an electrical short, owing to the presence of insulators 34, 36 and the offset arrangement of branches 20*b*, 22*b*, 24*b* and crimp terminals 20*c*, 22*c*, 24*c*, Each of the insulators 34, 36 is generally square in shape when viewed from above or in plan view, and includes a generally square opening 38 that substantially aligns with the respective openings 27 formed in the main body portions 20*a*, 22*a*, 24*a*. In the illustrated embodiment, the insulators 34, 36 are configured to snap together from either side of ground main body portion 22*a*, so that the insulators may be assembled to ground conductive body 22 prior to final assembly of electrical terminal assembly 10. To facilitate alignment of first insulator 34 relative to second insulator 36, first insulator 34 includes a pair of downwardly-extending projections 40 at diagonally-opposite corners, and a pair of notches 42 at the other diagonally-opposite corners, such as shown in FIG. 3. Similarly, second insulator 36 includes a pair of upwardly-extending projections 44 at diagonally-opposite corners corresponding to notches 42 of first insulator 34, and notches 46 at the other diagonally-opposite corners corresponding downwardly projections 40 of first insulator 34. As best shown in FIG. 1, notches 42 receive upward projections 44, and notches 46 receive downward projections 40. In addition, both of the insulators 34, 36 include four resilient latch tabs 48 that engage respective receiving regions 50 of the other insulator. Thus, latch tabs 48 cooperate with receiving regions 50 to allow the insulators 34, 36 to snap together, with ground main body portion 22*a* sandwiched between the respective inwardly-directed surfaces of the insulators 34, 36. If necessary, first insulator 34 may be separated from second insulator 36 by prying the insulators apart to release latch tabs 48 from the respective receiving regions 50. It is envisioned that insulators 34, 36 may be made from substantially any electrically insulating and compression-resistant material, such as injection molded resinous plastic. In addition, the positioning of latch tabs 48 and receiving regions 50 permit the first insulator 34 to be an identical component to second insulator 36, so that two identical insulators or insulative bodies are interchangeable and may be coupled to one another simply by rotating one insulator by 90-degrees relative to the other insulator, such as shown in FIGS. 3 and 6. Optionally, the insulative bodies may be unitarily formed and joined together by a flexible living hinge.

Figure 2:
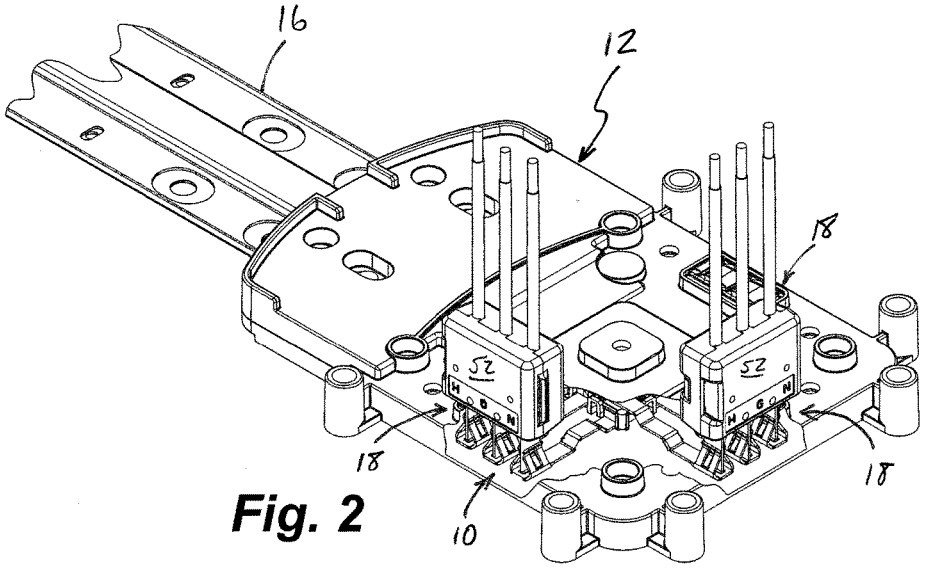
FIG. 2 is a top perspective view of the an electrical raceway and raceway junction incorporating the low profile electrical terminal assembly of FIG. 1, with an upper portion of the junction cut away to show part of the electrical terminal assembly.
Figure 8A:
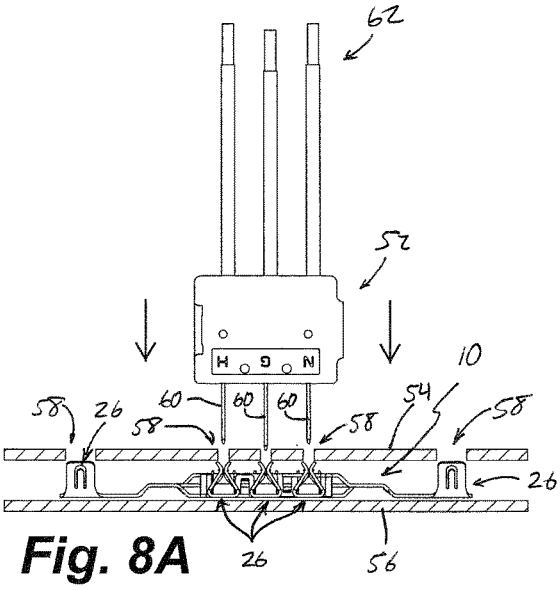
FIGS. 8A and 8B are side sectional elevations of the raceway junction of FIG. 7, and depicting the insertion of a male plug connector into the respective electrical terminals of the electrical terminal assembly.
Figure 8B:
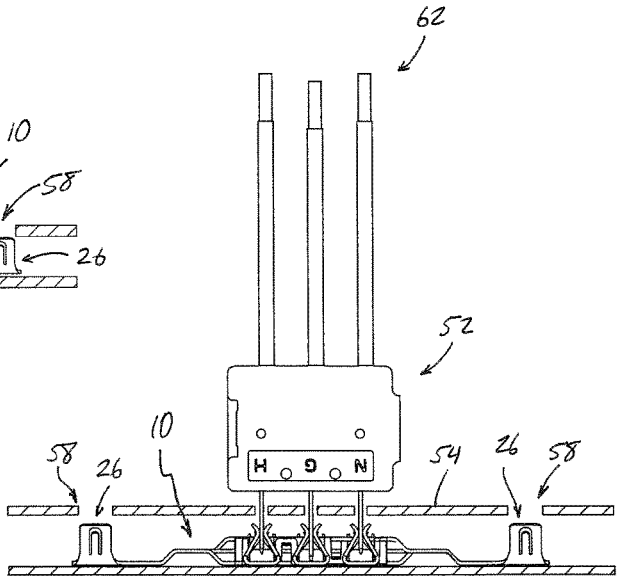

Referring to FIGS. 2 and 7-8B, low profile electrical terminal assembly 10 is positioned between an upper housing surface 54 and a lower housing surface 56 of raceway junction 12, with each set of three electrical terminals 26 aligned with a corresponding electrical receptacle region 18, in which openings 58 formed in upper housing surface 54 permit access to the respective electrical terminals 26 by respective prongs 60 of male plug 52, such as shown in FIGS. 2, 8A, and 8B. When the prongs 60 of respective male plugs 52 are engaged with the corresponding electrical terminals 26 of electrical terminal assembly 10, the prongs 60 establish electrical connections with the respective electrical conductors 14 that are routed along raceway 16. This allows electrical power to be routed through electrical conductors 62 associated with each male plug 52 to another location, such as shown in FIG. 7. Power may be supplied to electrical conductors 14 via crimped terminals 64 (FIG. 7), or substantially any other type of electrical connection or direct-wiring arrangement. It will further be appreciated that electrical power could be supplied to low profile electrical terminal assembly 10 via any one of male plugs 52 and its corresponding electrical conductors 62, although in that case female receptacles would typically be substituted for male plugs 52 and male plugs would be substitutes for receptacles 26.

Accordingly, the assembled low profile electrical terminal assembly 10 has a thin overall height, such as shown in FIG. 5, while providing positive insulation between the overlying conductive components or surfaces. Branch conductors of different polarities are laterally separated from one another, and are shaped so that the corresponding electrical terminals 26 all lie in substantially the same common terminal plane P4, and providing significant electrical contact areas for receiving the respective terminals of another electrical connector, such as a three-pronged male plug 52 (FIGS. 2 and 7-8B). Although the illustrated embodiment has its terminal plane P4 located coplanar with the plane P3 of neutral main body portion 24*a*, it will be appreciated that the electrical terminals 26 may be positioned substantially any desired elevation by changing the degree to which the respective branches change elevation along their length.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An electrical terminal assembly for use in a low-profile electrical raceway, said electrical terminal assembly comprising:

a first conductive body including a first main body portion, at least two first electrical terminals spaced outwardly from said first main body portion, and respective first conductor arms electrically coupling said first electrical terminals to said first main body portion, wherein said first main body portion is located in a first plane and said first electrical terminals are positioned in a terminal plane;

a second conductive body including a second main body portion, at least two second electrical terminals spaced outwardly from said second main body portion, and respective second conductor arms electrically coupling said second electrical terminals to said second main body portion, wherein said second main body portion is located in a second plane spaced below said first plane, and said second electrical terminals are positioned in said terminal plane;

wherein said terminal plane is non-coplanar with at least one of said first and second planes, and wherein each of said first electrical terminals is positioned adjacent a respective one of said second electrical terminals.

2. The electrical terminal assembly of claim 1, further comprising an insulative body disposed between said first main body portion and said second main body portion.

3. The electrical terminal assembly of claim 1, wherein said first plane is substantially parallel to said second plane and said terminal plane.

4. The electrical terminal assembly of claim 1, wherein said first and second electrical terminals each comprise respective base portions and upwardly-extending portions, and wherein said base portions are positioned in said terminal plane and said upwardly-extending portions are positioned above said terminal plane.

5. The electrical terminal assembly of claim 1, wherein at least one of said first conductor arms includes a middle region disposed between said first main body portion and a respective one of said first electrical terminals, at least one of said second conductor arms includes a middle region disposed between said second main body portion and a respective one of said second electrical terminals, and wherein said middle regions are coplanar with one another and are non-coplanar with said terminal plane.

6. The electrical terminal assembly of claim 5, further comprising a third conductive body including a third main body portion, at least two third electrical terminals spaced outwardly from said third main body portion, and respective third conductor arms electrically coupling said third electrical terminals to said third main body portion, wherein said third main body portion is located in a third plane spaced below said second plane, and said third electrical terminals are positioned in said terminal plane, wherein at least one of said third conductor arms includes a middle region disposed between said third main body portion and a respective one of said third electrical terminals, and wherein said middle region of said at least one of said third conductor arms is coplanar with said middle regions of said first and second conductor arms.

7. An electrical terminal assembly for use in a low-profile electrical raceway, said electrical terminal assembly comprising:

a first conductive body including a first main body portion, at least two first electrical terminals spaced outwardly from said first main body portion, and respective first conductor arms electrically coupling said first electrical terminals to said first main body portion, wherein said first main body portion is located in a first plane and said first electrical terminals are positioned in a terminal plane;

a second conductive body including a second main body portion, at least two second electrical terminals spaced outwardly from said second main body portion, and respective second conductor arms electrically coupling said second electrical terminals to said second main body portion, wherein said second main body portion is located in a second plane spaced below said first plane, and said second electrical terminals are positioned in said terminal plane;

a third conductive body including a third main body portion, at least two third electrical terminals spaced outwardly from said third main body portion, and respective third conductor arms electrically coupling said third electrical terminals to said third main body portion, wherein said third main body portion is located in a third plane spaced below said second plane, and said third electrical terminals are positioned in said terminal plane;

a first insulative body disposed between said first and second main body portions; and a second insulative body disposed between said second and third main body portions;

wherein each of said first electrical terminals is positioned adjacent a respective one of said second electrical terminals, and each of said second electrical terminals is positioned adjacent a respective one of said third electrical terminals.

8. The electrical terminal assembly of claim 7, wherein said first conductor arms extend outwardly in different respective directions from said first main body portion, said second conductor arms extend outwardly in different respective directions from said second main body portion, said third conductor arms extend outwardly in different respective directions from said third main body portion, and wherein the different respective directions of said first conductor arms correspond to the different respective directions of said second and third conductor arms.

9. The electrical terminal assembly of claim 8, wherein the different respective directions of said first, second and third conductor arms are oriented at about 90 degrees apart.

10. The electrical terminal assembly of claim 8, wherein the different respective directions of said first, second and third conductor arms are oriented at about 180 degrees apart.

11. The electrical terminal assembly of claim 7, wherein said first electrical terminals are configured to electrically and mechanically engage respective line polarity electrical conductors, said second electrical terminals are configured to electrically and mechanically engage respective ground polarity electrical conductors, and said third electrical terminals are configured to electrically and mechanically engage respective neutral polarity electrical conductors.

12. The electrical terminal assembly of claim 11, wherein at least one of said first electrical terminals is configured to electrically and mechanically engage a line polarity blade or bus bar, at least one of said second electrical terminals is configured to electrically and mechanically engage a ground polarity blade or bus bar, and at least one of said third electrical terminals is configured to electrically and mechanically engage a neutral polarity blade or bus bar.

13. The electrical terminal assembly of claim 7, wherein said first conductive body includes at least three of said first electrical terminals and at least three of said first conductor arms, said second conductive body includes at least three of said second electrical terminals and at least three of said second conductor arms, and said third conductive body includes at least three third electrical terminals and at least three of said third conductor arms.

14. The electrical terminal assembly of claim 13, wherein all of said first, second, and third electrical terminals are positioned in said terminal plane.

15. The electrical terminal assembly of claim 13, wherein said first conductive body includes at least four of said first electrical terminals and at least four of said first conductor arms, said second conductive body includes at least four of said second electrical terminals and at least four of said second conductor arms, and said third conductive body includes at least four third electrical terminals and at least four of said third conductor arms.

16. The electrical terminal assembly of claim 15, wherein all of said first, second, and third electrical terminals are positioned in said terminal plane.

17. The electrical terminal assembly of claim 16, wherein each of said conductor arms of each of said conductive bodies is oriented at either about 90 degrees or about 180 degrees relative to each other of said conductor arms of each of said conductive bodies.

18. The electrical terminal assembly of claim 7, wherein at least one each of said first, second, and third electrical terminals is configured to electrically and mechanically engage respective blade terminals or bus bars that are aligned substantially perpendicularly to said terminal plane.

19. The electrical terminal assembly of claim 7, wherein said first, second, and third planes are substantially parallel to one another.

* * * * *